United States Patent [19]

Wilson

[11] 4,010,870

[45] Mar. 8, 1977

[54] TOOTHPASTE DISPENSER AND CONTAINER

[75] Inventor: Esther Wilson, Apple Creek, Ohio

[73] Assignee: Lawrence Peska Associates, Inc., New York, N.Y. ; a part interest

[22] Filed: Mar. 12, 1975

[21] Appl. No.: 557,769

[52] U.S. Cl. ..... 222/78; 222/95

[51] Int. Cl.[2] ..... B65D 35/30

[58] Field of Search ..... 222/78, 92, 95, 103, 222/96, 105

[56] References Cited

UNITED STATES PATENTS

| | | | |
|---|---|---|---|
| 2,213,901 | 9/1940 | Crawford | 222/78 UX |
| 2,652,949 | 9/1953 | Martin | 222/95 |
| 3,105,612 | 10/1963 | Krasnoff et al. | 222/78 |
| 3,178,060 | 4/1965 | Bossack | 222/78 |
| 3,741,439 | 6/1973 | Vehrs | 222/103 |

*Primary Examiner*—Stanley H. Tollberg
*Assistant Examiner*—Norman L. Stack, Jr.

[57] ABSTRACT

A container for dispensing toothpaste is adapted to receive a flexible tube of toothpaste. The container includes a toy figure holding a simulated tube of toothpaste, wherein the arm and hand holding the simulated tube is in an extended horizontal plane. A squeezing mechanism is provided for squeezing the flexible tube within the chamber of the container. A tube member is contained in the extended arm, wherein the tube member extends from the flexible tube to the simulated tube. The toothpaste is transported through the tube member from the flexible tube and outwardly through the simulated tube.

3 Claims, 4 Drawing Figures

TOOTHPASTE DISPENSER AND CONTAINER

SUMMARY OF THE INVENTION

My present invention relates to a unique and novel container for dispensing toothpaste from a flexible tube contained within the container.

A number of U.S. Patents: U.S. Pat. Nos. 1,637,667; 2,792,161; and 3,178,060 have been employed as variously designed containers for toothpaste, but these aforementioned patents are non-applicable to my present invention.

An object of my present invention is to provide a container for holding and dispensing toothpaste.

A further object of my present invention is to provide a flexible tube for holding toothpaste.

A still further object of my present invention is to provide a means for controlling the flow of toothpaste from the container.

Briefly, my present invention comprises a toy figure holding a simulated tube of toothpaste, wherein the arm and hand holding the simulated tube is in an extended horizontal plane. A squeezing mechanism is provided for squeezing the flexible tube within the chamber of the container. A tube member is contained in the extended arm, wherein the tube member extends from the flexible tube to the simulated tube. The toothpaste is transported through the tube member from the flexible tube and outwardly through the simulated tube.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
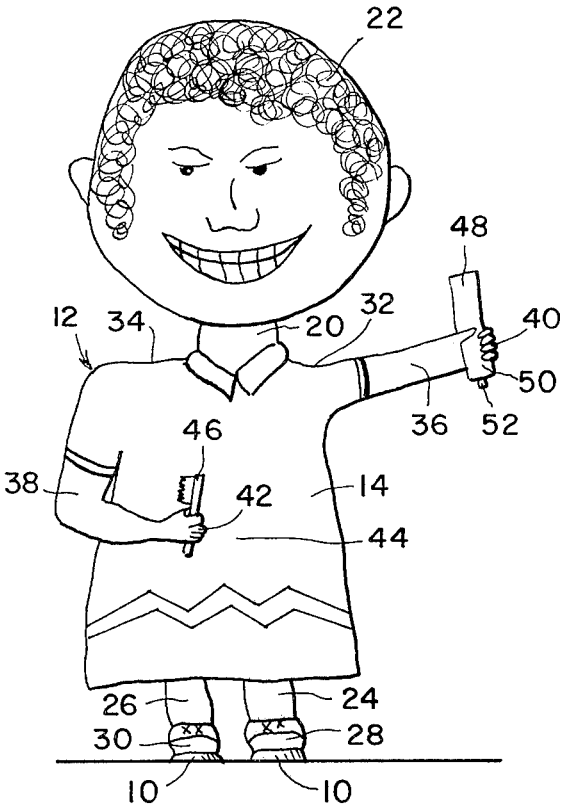
FIG. 1 illustrates a front view of a container for a toothpaste tube.
Figure 2:
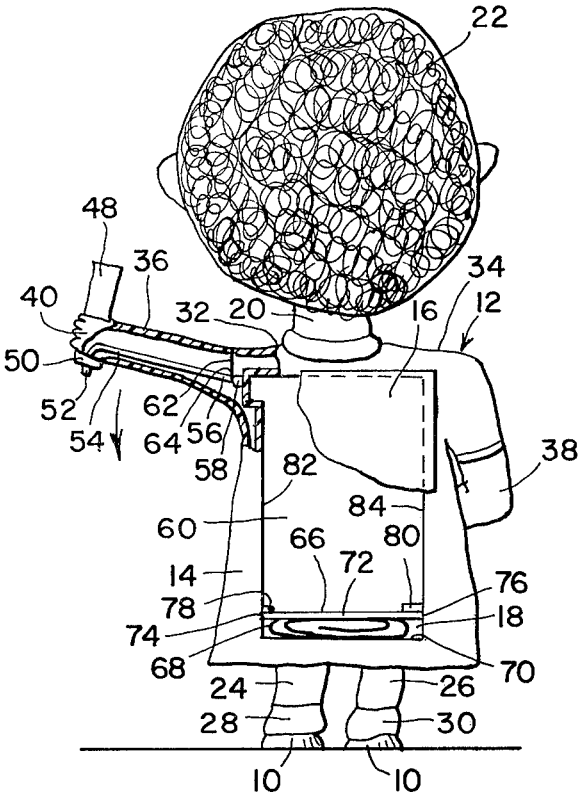
FIG. 2 illustrates a back view of the container.

Turning now descriptively to the drawings in which similar reference characters denote similar elements throughout the several views:

FIGS. 1, 2 show a toy figure such as "Charlie Brown" adapted to receive a flexible tube 60 of toothpaste, wherein the toy figure is a container 12 for dispensing toothpaste. The container 12 formed in the shape of "Charlie Brown" has a body 14 with a removable rear panel 16 and a chamber 18 therein. The body 14 also has a neck 20, a head 22, a pair of legs 24, 26, a pair of feet 28, 30, a pair of rigid shoulders 32, 34, a pair of arms 36, 38, and a pair of hands 40, 42. One of the arms 36 extends horizontally outward from the body 14. The other arm 38 and hand 42 are bent forwardly in front of the stomach area 44 of the body 14. The hand 42 of the other arm 38 is adapted to receive a toothbrush 46. The hand 40 of the one arm 36 is adapted to receive a simulated tube 48 of toothpaste having a neck portion 50 with a detachably mounted screw cap 52 thereon. A tube member 54 is contained within the arm 36, wherein one end 56 of the tube member 54 extends from the shoulder 32 of arm 36 to the free end of the neck portion 50 of tube 48. A rubber gasket 58 is affixed onto the one end 56 of tube member 54. A flexible tube 60 of toothpaste is contained within chamber 18, wherein tube 60 engages rubber gasket 58. A valve mechanism communicates with tube member 54 for controlling the flow of toothpaste through tube member 54, wherein the valve mechanism comprises a rod 62 extending downwardly from said shoulder 32 and extending into tube member 54 through a hole 64 contained in tube member 54. When the arm 36 is flexed downwardly, tube member 54 is pulled away from rod 62. A squeezing mechanism that engages the bottom base 66 of flexible tube 60 within chamber 18 pushes upwardly so as to squeeze tube 60.

Figure 4:
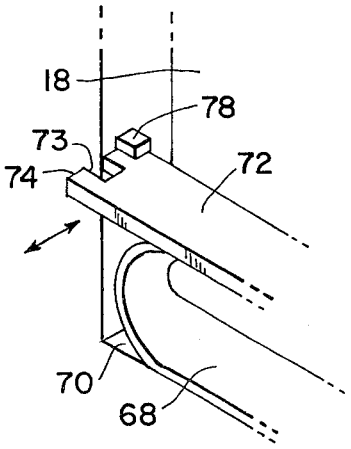
FIG. 4 illustrates a perspective sectional view of a squeezing mechanism for the toothpaste tube contained within the container.

The squeezing mechanism as shown in FIG. 4 comprises a coil spring 68 affixed onto the bottom base 70 of chamber 18. An elongated platform 72 is horizontally placed onto top of coil spring 68 such that platform 72 engages the bottom base 66 of tube 60. Notches 73 are contained in each end 74, 76 of platform 72. Flange members 78, 80 are contained on each vertical end wall 82, 84 of chamber 18, wherein notches 73 fit over flange members 78, 80 to hold platform 72 in a horizontally plane.

Figure 3:
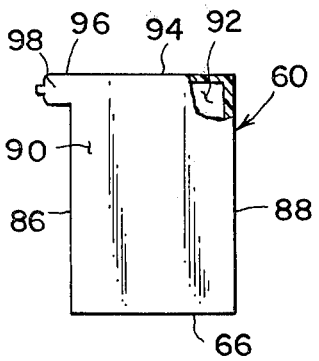
FIG. 3 illustrates a rear view of a toothpaste tube.

FIGS. 2, 3 shows the flexible tube 60 having the bottom base 66, a pair of upwardly extending end walls 86, 88, an upwardly extending front wall 90, an upwardly extending rear wall 92, and an upper end 94. A side arm 96 having a bore 98 continuous therethrough is affixed onto an end wall 86, wherein the side arm 96 communicates with rubber gasket 58.

Referring back to FIG. 1, a suction cup member 10 is affixed onto the bottom of each foot 28, 30.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A container for dispensing toothpaste, which comprises:

a. a toy figure of a person having a main body with a chamber therein, said main body having a removable rear panel therein, a neck extending upwardly from said body, a head affixed to said neck, a pair of rigid shoulders, a pair of legs with attached feet, said legs extending downwardly from said body, a pair of arms with hands, said arms affixed to said rigid shoulders, at least one of said arms of a flexible composition extending horizontally outwardly from said body, and said hand of one said arm having a simulated tube of toothpaste therein, said tube of toothpaste having a neck portion with an externally threaded surface thereon; said tube of toothpaste having an opening therein;

b. a screw cap member threadably engaging said neck portion;

c. a tube member contained in one said flexible arm, said tube member extending from said chamber through said one flexible arm, through said hand into said opening of said tube of toothpaste; said tube member having a hole therein;

d. a rubber gasket member affixed onto said end of said tube member, said rubber gasket positioned within said chamber;

e. a flexible tube of toothpaste contained in said chamber, said flexible tube of toothpaste having a base, a pair of upwardly extending end walls, an upwardly extending rear wall, an upwardly extending front wall, an upper end, and a side arm having a bore there through, said side arm affixed onto one said end wall, a free end of said side arm communicating with said rubber gasket;

f. a suction cup member affixed onto each said foot of said toy figure;

g. a rod member contained in said flexible arm, said rod member affixed to said shoulder, said rod member extending downwardly from said shoulder into said tube through said hole in said tube, said arm flexing downwardly as said tube pulls away from said stationary rod member;

h. a coil spring affixed onto a base of said chamber;

i. a horizontally placed platform affixed onto said coil spring, said platform engaging said base of said flexible tube of toothpaste, each end of said platform having notches therein; and j. a flange member contained on each vertical end wall of said chamber, one said flange member slidably contained in each said notch of said platform for maintaining said platform in a horizontal plane within said chamber.

2. A container as recited in claim 1, wherein said other arm of said toy figure is adapted to receive a toothbrush.

3. A container as recited in claim 1, wherein said figure is Charlie Brown.

* * * * *